United States Patent [19]

Chiba et al.

[11] Patent Number: 4,826,747

[45] Date of Patent: May 2, 1989

[54] ELECTROPHOTOGRAPHIC METHOD USES TONER OF SPECIAL SIZE RELATIVE TO EXPOSURE LIGHT BEAM

[75] Inventors: Shunichi Chiba, Numazu; Satoru Inoue, Mishima, both of Japan

[73] Assignee: Ricoh Company, Ltd., Tokyo, Japan

[21] Appl. No.: 100,262

[22] Filed: Sep. 23, 1987

[30] Foreign Application Priority Data

Sep. 29, 1986 [JP] Japan ..... 61-232728

[51] Int. Cl.[4] ..... G03G 13/01

[52] U.S. Cl. ..... 430/54; 430/45; 430/494; 430/945; 430/120; 430/111; 430/117; 346/160

[58] Field of Search ..... 430/31, 42, 45, 945, 430/1, 111, 120, 117, 494; 355/14 E; 346/160

[56] References Cited

U.S. PATENT DOCUMENTS 4,220,698 2/1980 Brynko et al. ..... 430/106.6

4,515,879 5/1985 Kuehnle et al. ..... 430/396

*Primary Examiner*—J. David Welsh

*Attorney, Agent, or Firm*—Oblon, Fisher, Spivak, McClelland & Maier

[57] ABSTRACT

An electrophotographic method is disclosed, in which electrostatic latent images are formed on an electrophotographic photoconductor by exposure of the photoconductor to a light beam, and the formed electrostatic latent images are developed to visible toner images by a developer comprising toner particles, with the minimum diameter D of the light spot of the light beam on the photoconductor and the volume mean diameter $X_w$ of the toner particles being in the relationship of $(D)\mu m \geqq 9.0 \times (X_w)\mu m - 34$.

9 Claims, 2 Drawing Sheets

ELECTROPHOTOGRAPHIC METHOD USES TONER OF SPECIAL SIZE RELATIVE TO EXPOSURE LIGHT BEAM

BACKGROUND OF THE THE INVENTION

The present invention relates to an electrophotography in which electrostatic latent images are formed on electrophotographic photoconductor by digital exposure of the photoconductor to a light beam and the formed electrostatic latent images are developed to visible toner images by a developer comprising toner particles, with the key feature that a particular relationship is set between (i) the minimum diameter of a light spot of the light beam for the formation of the latent electrostatic images on the photoconductor and (ii) the volume mean diameter of the toner particles of the developer.

In the conventional, so-called digital image formation process in which electrostatic latent images are formed on a photoconductor by digital exposure of the photoconductor to a light beam and the thus formed electrostatic latent images are developed to visible toner image by a toner developer, gradation reproduction methods for continuous or halftone reproduction, such as the dot-matrix method and dot-size variation method, are employed. In these conventional gradation reproduction methods, however, the matching of the diameter of the light spot of the light beam for the formation of latent electrostatic images on the photoconductor with the particle size of the toner developer is not taken into consideration, so that tone jump in the image gradation and image deformation tend to occur due to the so-called "dot gain", with the result that the obtained image quality is poor. Further, in these methods, original line images tend to become thicker than the original line image when reproduced and the gradation reproduction also tends to change in the course of continuous copying.

In particular, when full-color image formation is performed by digital writing with a light beam in the above methods, using three colors (cyan, yellow and magenta) or four colors (cyan, yellow, magenta and black) which are superimposed for obtaining color images, once dot gain takes place in the formation of each color image, not only tone jump and image deformation, but also the formation of poor quality images with lack of sharpness, takes place, because the superimposed toners spread either at the time of transferring of the images to a transfer sheet or at the time of fixing of the images thereto.

The previously mentioned term "dot gain" is originally used in the field of printing, which means the phenomenon that in comparison with halftone dots on a film, the corresponding halftone dots become thicker when actually printed. The term "dot gain" is also used in the field of electrophotography in a similar sense to the above, meaning that in comparison with digital, matrix-like electrostatic latent images formed on an electrophotographic photoconductor, the corresponding images become thicker when developed to visible images. In the conventional digital image formation method, gradation reproduction is performed by area reproduction using a dot matrix. In such digital image formation method, however, in comparison with dot-like electrostatic latent images formed on a photoconductor, the corresponding developed images become thicker, so that exact area reproduction cannot be usually attained.

SUMMARY OF THE INVENTION

It is therefore an object of the present invention to provide an electrophotographic method of forming electrostatic latent images on an electrophotographic photoconductor by exposure of the photoconductor to a light beam, and developing the formed electrostatic latent images to visible toner images by a developer comprising toner particles, which electrophotographic method is particularly capable of providing high quality images with excellent gradation reproduction, high resolution and sharpness, free from deterioration of gradation reproduction which may be caused by dot gain, even in the course of extended continuous copy making.

The above object of the present invention can be attained by setting the following relationship between (i) the minimum diameter (D) of a light spot of the light beam for the formation of the latent electrostatic images on the photoconductor and (ii) the volume mean diameter ($X_w$) of the toner particles of the developer in the above electrophotographic method:

$$(D)\ \mu m \geqq 9.0 \times (X_w)\ \mu m - 34$$

DETAILED DESCRIPTION OF THE PREFERRED EMBODIMENTS

Figure 1A:
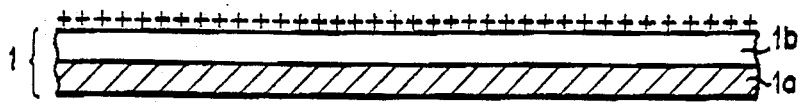
FIGS. 1(*a*), 1(*b*) and 1(*c*) are schematic cross-sectional diagrams showing the formation of electrostatic latent images on a photoconductor and the development of the electrostatic latent images to visible toner images.
Figure 1B:
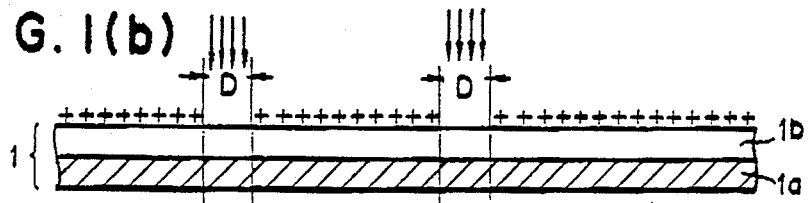
Figure 1C:
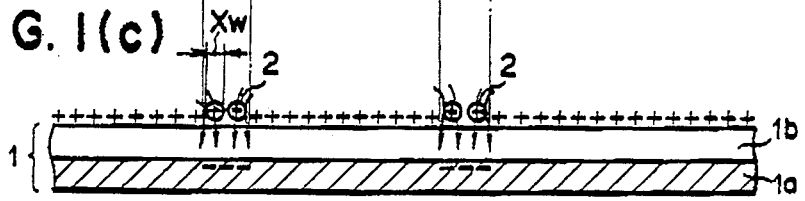
Figure 2:
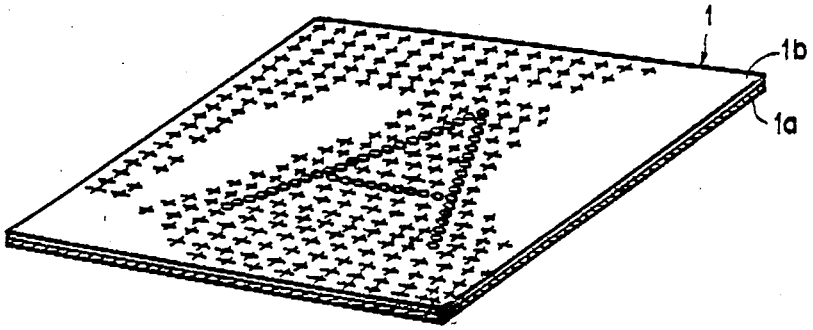
FIG. 2 is a schematic perspective illustration of the formation of latent electrostatic images on a photoconductor.

With reference to FIGS. 1(*a*), 1(*b*) and 1(*c*), the formation of an electrostatic latent image on an electrophotographic photoconductor and the development of the latent image to a visible toner image will now be explained.

An electrophotographic photoconductor 1 comprising a substrate 1*a* and a photoconductive layer 1*b* is uniformly electrically charged in the dark, so that the photoconductive layer 1*b* is charged, for instance, to a positive polarity as illustrated in FIG. 1(*a*). Then a light beam having a minimum light spot diameter of (D) μm is applied imagewise to the positively charged photoconductive layer 1*b*, whereby an electrostatic latent image is formed on the photoconductive layer 1*b*. The thus formed electrostatic latent image is developed to a visible toner image with the developer comprising toner particles 2 having, for instance, a positive polarity, and a volume mean diameter of ($X_w$) μm as ellustrated in FIG. 1(*c*). In the present invention, it is preferable to form a negative latent image for reverse development by the procedure as illustrated in FIGS. 1(*a*) through 1(*c*).

In the present invention, for attaining the object thereof, the following relationship is set between (i) the minimum diameter (D) μm of a light spot of a light beam for the formation of a latent electrostatic images on the photoconductor and (ii) the volume mean diameter ($X_w$) μm of the toner particles of the developer in the above electrophotographic method:

$$(D)\ \mu m \geqq 9.0 \times (X_w)\ \mu m - 34$$

The above relationship is derived as follows. It is considered that the amount of the toner deposited in a portion having an area of $D^2$ for development on a photoconductor, corresponding to a development spot (D) (refer to FIG. 1(*b*)), is primarily related to the dot gain which may be caused by the deforming or spreading of the deposited toner either at the time of image fixing or at the time of image transfer, or both. Further it is considered that the smaller the area of the development spot, the greater the dot gain when the amount of the deposited toner is the same.

In this situation, the following relationship exists among the dot gain, the deposition of the toner, the area of the spot, $D^2$, and the circumference of the spot, 4D:

$$\text{Dot gain} = \frac{\text{Amount of Deposited Toner}}{\frac{4D}{D^2}} \quad (1)$$

For covering the dot completely with the toner, one or two layers of the toner are necessary. It is considered from this that the amount (M) of the deposited toner, by which the spot is completely covered with the toner, is approximately linearly proportional to the volume mean diameter of the toner particles.

Suppose that the volume mean diameter of the toner particles is $X_w$, there is the following relationship between M and $X_w$:

$$(M/A)\ \alpha(X_w) \times D^2/D^2 \alpha(X_w) \quad (2)$$

wherein A is a constant.

From the formulas (1) and (2), the following formula (3) can be obtained:

$$\text{Dot gain} \propto \frac{X_w}{D} \leqq A \quad (3)$$

The above can be modified as follows:

$$(X_w)\ \mu m \leqq B \times (D)\ \mu m \quad (4)$$

wherein B is a constant.

In practice, however, the above formula (4) will have to be modified to some extent because of variable factors such as the shape of the toner particles, the fixing property of the toner, and some dust which may enter at the time of image transfer.

For instance, in order that the toner be firmly fixed to the surface of a transfer paper, it is necessary that the toner cling to the fibers of the paper or enter among the fibers of the paper at the toner fixing portions. Accordingly, the larger the toner particles, the more the required energy for the image fixing. In the case where an image fixing roller is in contact with the toner deposited on a transfer paper at a place where the image fixing roller is in direct contact with the toner, thermal energy is directly supplied to the toner from the image fixing roller. The temperature of the portion where the toner is in direct contact with the image fixing roller is higher than the temperature of the portion where the toner is in contact with the transfer paper. Accordingly the viscoelasticity of the toner is smaller at the portion where the toner is in direct contact with the image fixing roller than the viscoelasticity thereof at the portion where the toner is in contact with the transfer paper, so that the toner particles on the transfer paper become more easily deformed or flattened at the portion where the toner is in direct contact with the image fixing roller. In contrast to this, when toner particles having smaller particle sizes are employed, the distance between the surface of the image fixing roller and the surface of the transfer paper is short. Accordingly, the temperature gradient within the toner particles on the transfer paper is so small that it is considered that the temperature of the toner particles in contact with the image fixing roller is almost equal to the temperature of the toner particles in contact with the image transfer paper. For the above reason, the larger the particle size of the toner, the more easily deformed or flattened the toner particles, and accordingly the greater the dot gain.

Further at the time of image fixing, the toner is heated and accordingly it is visco-elastic. Therefore, suppose that a toner having a large particle size and a toner having a small particle size have an identical surface tension, the toner having a smaller particle size is less deformed.

From the above considerations, the formula (4) may be modified to the following primary approximate expression:

$$(D)\ \mu m \geqq C \times (X_w)\ \mu m + D \quad (5)$$

where C and D are both constants.

The constants C and D in the above formula are determined from the examples mentioned later, whereby the following formula is obtained:

$$(D)m \geqq 9.0 \times (X_w)\ \mu m - 34$$

The present invention is based on the above formula. A toner for use in the present invention comprises a dye or pigment.

Examples of a dye or pigment for use in the toner are carbon black, Nigrosine Dye, Anilin Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, and mixtures thereof. It is preferable that these dyes or pigments be contained in a sufficient amount for formation of visible image in the toner.

As the binder agents for use in the toner, binder resins employed in the conventional toners for electrophotography can be employed. Examples of such binder resin are polyester resin, epoxy resin, styrene - acryl copolymer resin, phenolic resin, maleic acid resin, alkyd resin, butyral resin, styrene—butadiene copolymer resin, wax rosin, fiber resin, acetal resin, and vinylidene resin. These can be employed alone or in combination.

The toner for use in the present invention can be prepared by any of conventional methods. For example, a binder resin, a coloring agent, and an additive such as a charge control agent when necessary, are kneaded at temperatures above the melting point of the binder resin, cooled, pulverized and classified so as to obtain toner having a volume mean diameter which satisfies the previously mentioned relationship between the light spot diameter and the volume mean diameter of the toner. As such toner, those prepared by the spray-dry method, the in-situ method and the suspension polymerization method can also be employed.

In the present invention, finely-divided particles of $TiO_2$, $Al_2O_3$ and $SiO_2$ can be added to the above prepared toner particles so as to cover the surface of the toner particles with those finely-divided particles for improvement of the fluidity of the toner. Further an additive, such as zinc stearate and phthalic acid, may be added to the toner for preventing the deterioration of the photoconductor so long as such treated toner particles satisfy the above-mentioned relationship between the light spot diameter and the volume mean diameter of the toner. In addition a charge control agent, such as Bontron S-34 made by Oriental Chemical Industries, Ltd., may be employed when necessary.

As the developer for use in the present invention, not only the above-mentioned toners, but also a two-component developer comprising toner particles and carrier particles having a particle size larger than that of the toner particles may be employed.

As such carrier particles, finely-divided particles of iron, nickel, ferrite, and magnetite, glass beads, conventional resin-coated particles of these metals and metal oxide and glass beads, having a particle size ranging from about 50 μm to 300 μm, can be employed.

The particle size distributions of the toner particles and carrier particles can be measured by a Coulter counter which is commercially available from Coulter Electronics Co., Ltd. in the United States, based on the electric resistance method called "Coulter Principle", using an aperture tube having a diameter of 100 μm for the toner particles, and an aperture tube having a diameter of 500 μm for the carrier particles.

Figure 3:
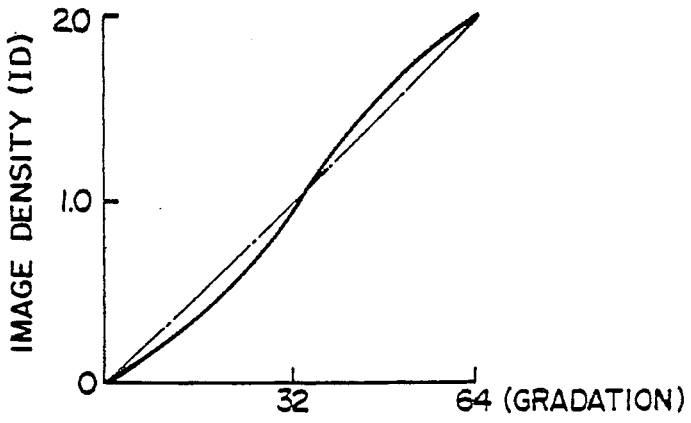
FIG. 3 is a graph showing the relationship between the image density and the number of gradation steps (65 gradations with an $8 \times 8$ matrix) of images free from dot gain.
Figure 4:
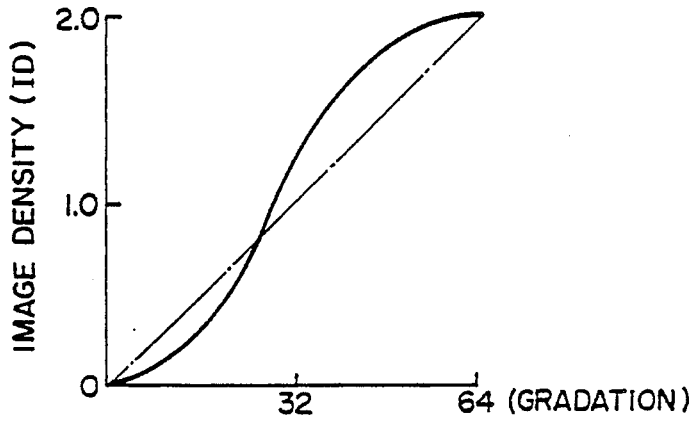
FIG. 4 is a gaaph showing the relationship between the image density and the number of gradation steps (65 gradations with an $8 \times 8$ matrix) of images with a large dot gain.

FIG. 3 shows the relationship between the image density and the number of gradation steps (64 gradations with an 8×8 matrix) of images free from dot gain. FIG. 4 shows the relationship between the image density and the number of gradation steps (64 gradations with an 8×8 matrix) of images with a large dot gain.

FIG. 3 and FIG. 4 indicate that in the images free from dot gain, the number of gradation steps is proportional to the image density so that excellent gradation reproduction is obtained, while in the images with a large dot gain, the number of gradation steps is not proportional to the image density and the image density does not increase even when the number of gradation steps is to 50 or more so that proper gradation reproduction is not obtained any further.

As the matter of course, the present invention can be applied to full-color image formation, using any of a cyan toner, a magenta toner, a yellow toner and a black toner.

With reference to the following examples, the present invention will now be explained in detail. The features of the present invention will become apparent in the course of the following description of the examples, which are given for illustration of the invention and not intended to be limiting thereof.

EXAMPLE 1

A mixture of the following components was fused and kneaded in a heat roll mill, cooled and then roughly crushed by a hammer mill. The roughly crushed mixture was then finely divided by an air-jet pulverizer, whereby finely-divided powder was obtained. The thus obtained finely-divided powder was then classified so that finely-divided powder having a volume mean diameter of 7.0 μm was obtained:

| | Parts by Weight |
|---|---|
| Polyester resin (softening point: about 100° C.) | 100 |
| Carbon black | 7 |
| Bontron S-34 (made by Oriental Chemical Industries, Ltd.) | 5 |

0.3 parts by weight of hydrophobic silica were mixed with 100 parts by weight of the finely-divided powder, whereby a toner was prepared.

3.5 parts by weight of the toner were mixed with 100 parts by weight of carrier particles consisting of a ferrite core coated with a silicone resin, whereby a two-component type developer for use in the present invention was prepared.

By using this developer, an electrostatic latent image was developed by a dry type electrophotographic copying machine (Modified Ricopy FT-4030 made by Ricoh Co., Ltd., with a scanner and a laser writing system incorporated therein, constituting an 800 DPI (dots per inch) digital copier) under the ambient conditions of 10° C., 15% RH, and 20° C., 60% RH. In this development, pseudo-halftone development with 65 gradations was performed using an 8×8 dot matrix with a Bayer arrangement. The result was that the obtained image density (ID) increased in proportion to the number of the steps of gradations.

The obtained images were inspected by an optical microscope and it was confirmed that there was no dot gain in the obtained images, resulting in perfect dot reproduction. The reproduction was excellent not only with respect to characters, but also with respect to line images. Further, a pictorial image was input to the image scanner to produce the image. The obtained image was free from tone jump and smooth in the reproduction of the halftone areas, with high image quality.

By using the above developer, 20,000 copies were continuously made. The result was that the obtained copy images were excellent in quality and free from deterioration in the course of the continuous copying.

By changing the diameter of the laser beam of the dry type electrophotographic copying machine in such a manner that the dot per inch was 800 DPI, 600 DPI, 400 DPI and 300 DPI, the relationship between the minimum diameter of the light spot for digital writing and the volume mean diameter of the toner was investigated in view of the dot gain and image quality. More specifically, the following tests were conducted. With each image element being composed of an 8 ×8 dot matrix, an electrophotographic photoconductor was exposed to a laser beam in accordance with a Bayer arrangement to form an electrostatic latent image. The thus obtained electrostatic latent image was developed with each of the developers shown in Table 1 so as to reproduce images with a 65-gradation pseudo-halftone. In the obtained images, such portions as those in which the developed area theoretically occupies 50% of the entire image area by the exposure to the laser beam were subjected to the measurement of toner image area by a commercially available image analysis system ("Luzex" made by Toyo Ink Mfg. Co., Ltd.), and the percentage of the dot gain was assessed in accordance with the following formula:

$$\text{Dot gain (\%)} = \frac{\text{Found percentage of toner image area}}{\text{Theoretical percentage of toner image area}} \times 100\ (\%)$$

The results are shown in Table 1.

The obtained 65-gradation images were visually inspected and evaluated with respect to the image quality thereof by 20 persons in accordance with a 5-rank evaluation scale (5: best; 1: worst; 3: medium; 2: between 1 and 3; and 4: between 3 and 4), particularly with the following points of the image quality:

(i) overall impression with respect to gradation reproduction.

(ii) whether or not there is a tone jump in image gradation.

(iii) whether or not there is a non-uniformity in the reproduction of each dot.

An overall evaluation of image quality was performed from the above three points by 20 persons. The average scores in accordance with the above-mentioned evaluation scale were obtained. The results are shown in Table 1 in which indicates 5; , 4; Δ, 3; x, 2; and xx, 1. "20,000" indicates "when making 20,000 copies".

EXAMPLE 2

Four kinds of two-component developers were prepared by mixing (i) 4 kinds of toners having volume mean diameters of 9.0 μm, 10.5 μm, 12.0 μm and 13.5 μm, which were prepared in the same manner as in Example 1, and (ii) the same carrier particles prepared in Example 1, in the same weight ratio as in Example 1.

By using these four two-component developers, development was performed by the same modified electrophotographic copying machine as that employed in Example 1. By changing the diameter of the laser beam of the dry type electrophotographic copying machine in the same manner as in Example 1, the relationship between the minimum diameter of the light spot for digital writing and the volume mean diameter of the toner was investigated in view of the dot gain and image quality. The results are shown in Table 1.

TABLE 1

| Volume Mean Diameter of Toner | | Minimum Light Spot Diameter 32 μm (800 DPI) | 48 μm (600 DPI) | 64 μm (400 DPI) | 84 μm (300 DPI) |
|---|---|---|---|---|---|
| 7.0 μm | Initial | 105% | 105% | 103% | 102% |
| | 20,000 | 107% | 106% | 105% | 105% |
| | Image Quality | | | | |
| 9.0 μm | Initial | 115% | 106% | 105% | 105% |
| | 20,000 | 120% | 109% | 107% | 107% |
| | Image Quality | Δ | | | |
| 10.5 μm | Initial | 122% | 120% | 106% | 106% |
| | 20,000 | 125% | 126% | 108% | 106% |
| | Image Quality | x | Δ | | |
| 12.0 μm | Initial | 125% | 125% | 119% | 107% |
| | 20,000 | 126% | 128% | 125% | 107% |

TABLE 1-continued

| Volume Mean Diameter of Toner | | Minimum Light Spot Diameter 32 μm (800 DPI) | 48 μm (600 DPI) | 64 μm (400 DPI) | 84 μm (300 DPI) |
|---|---|---|---|---|---|
| | Image Quality | xx | xx | Δ | |
| 13.5 μm | Initial | 125% | 125% | 124% | 120% |
| | 20,000 | 130% | 130% | 125% | 124% |
| | Image Quality | xx | xx | x | Δ |

EXAMPLE 3

A mixture of the following components was fused and kneaded in a heat roll mill, cooled and then roughly crushed by a hammer mill. The roughly crushed mixture was then finely divided by an air-jet pulverizer, whereby finely-divided powder was obtained as in Example 1. The thus obtained finely-divided powder was then classified, so that five different finely-divided powders having volume mean diameters of 7.0 μm, 9.0 μm, 11.0 μm, 13.0 μm, and 15.0 μm were obtained:

| | Parts by Weight |
|---|---|
| Styrene - butadiene methyl acrylate copolymer (softening point: about 100° C.) | 100 |
| Carbon black | 7 |
| Bontron S-34 (made by Oriental Chemical Industries, Ltd.) | 5 |

0.3 parts by weight of hydrophobic silica were mixed with 100 parts by weight of each of the above finely-divided powders, whereby five different toners were prepared.

3.5 parts by weight of each toner were mixed with 100 parts by weight of the same carrier particles employed in Example 1, whereby five two-component type developers for use in the present invention were prepared.

By using these five two-component developers, development was performed by the same modified electrophotographic copying machine as that employed in Example 1. By changing the diameter of the laser beam of the dry type electrophotographic copying machine in the same manner as in Example 1, the relationship between the minimum diameter of the light spot for digital writing and the volume mean diameter of the toner particles was investigated in view of the dot gain and image quality. The result was that the obtained copy images were excellent in quality and free from deterioration in the course of the continuous copying. More specific results are shown in Table 2.

TABLE 2

| Volume Mean Diameter of Toner | | Minimum Light Spot Diameter 32 μm (800 DPI) | 48 μm (600 DPI) | 64 μm (400 DPI) | 84 μm (300 DPI) |
|---|---|---|---|---|---|
| 7.0 μm | Initial | 103% | 103% | 103% | 102% |
| | 20,000 | 105% | 105% | 104% | 102% |
| | Image Quality | | | | |
| 9.0 μm | Initial | 110% | 106% | 104% | 104% |
| | 20,000 | 113% | 106% | 104% | 104% |
| | Image Quality | Δ | | | |
| 11.0 μm | Initial | 117% | 116% | 107% | 106% |

TABLE 2-continued

| Volume Mean Diameter of Toner | | Minimum Light Spot Diameter 32 μm (800 DPI) | 48 μm (600 DPI) | 64 μm (400 DPI) | 84 μm (300 DPI) |
|---|---|---|---|---|---|
| | 20,000 Image Quality | 120% xx | 120% x | 107% | 107% |
| 13.0 μm | Initial | 118% | 117% | 113% | 108% |
| | 20,000 Image Quality | 120% xx | 120% xx | 115% Δ | 108% |
| 15.0 μm | Initial | 118% | 118% | 110% | 110% |
| | 20,000 Image Quality | 120% xx | 120% xx | 112% x | 112% Δ |

According to the present invention, there is provided an electrophotographic method which is particularly capable of providing high quality images with excellent gradation reproduction, high resolution and sharpness, free from deterioration of gradiation reproduction which may be caused by dot gain, even in the course of extended continuous copy making.

What is claimed is:

1. An electrophotographic method of forming electrostatic latent images on a uniformly electrically charged electrophotographic photoconductor by exposure of the photoconductor to a light beam, and developing the formed electrostatic latent images to visible toner images by a developer comprising toner particles, with the minimum diameter D of the light spot of said light beam on said photoconductor and the volume mean diameter $X_w$ of said toner particles being in the relationship of (D) $\mu m \geqq 9.0 \times (X_w)\ \mu m - 34$.

2. The electrophotographic method as claimed in claim 1, wherein said visible toner images are transferred to a transfer sheet.

3. The electrophotographic method as claimed in claim 1, wherein said visible toner images are full-color images.

4. The electrophotographic method as claimed in claim 3, wherein said full-color images are formed by superimposing any of a cyan toner, a magenta toner, a yellow toner and a black toner.

5. The electrophotographic method as claimed in claim 1, wherein the surface of said toner particles is covered with a fluidity improvement agent.

6. The electrophotographic method as claimed in claim 5, wherein said fluidity improvement agent is selected from the group consisting of $TiO_2$, $Al_2O_3$ and $SiO_2$ in the form of finely-divided particles.

7. The electrophotographic method as claimed in claim 1, wherein said developer is a two-component developer comprising said toner particles and carrier particles having a particle size larger than the particle size of said toner particles.

8. The electrophotographic method as claimed in claim 7, wherein said carrier particles are finely-divided particles of iron, nickel, ferrite, magnetite, glass beads, resin coated metal particles or metal oxides.

9. The electrophotographic method as claimed in claim 8, wherein carrier particles have a particle size ranging from 50 μm to 300 μm.

* * * * *